US005450663A

United States Patent [19]

Calandra, Jr. et al.

[11] Patent Number: 5,450,663

[45] Date of Patent: Sep. 19, 1995

[54] METHOD FOR FABRICATING A TRUSS MEMBER FOR A MINE ROOF SUPPORT

[75] Inventors: Frank Calandra, Jr., Pittsburgh, Pa.; Jerry E. Frease, Lexington, Ky.; Lajos Kovacs, Mansfield, Ohio; John C. Stankus, Canonsburg; Eugene H. Stewart, Pittsburgh, both of Pa.

[73] Assignee: Jennmar Corporation, Pittsburgh, Pa.

[21] Appl. No.: 142,710

[22] Filed: Oct. 26, 1993

Related U.S. Application Data

[62] Division of Ser. No. 962,255, Oct. 16, 1992, Pat. No. 5,302,056.

[51] Int. Cl.[6] ..... B23P 11/00

[52] U.S. Cl. ..... 29/437; 29/DIG. 3; 29/DIG. 18

[58] Field of Search ..... 29/34 R, 437, 444, 512, 29/522.1, DIG. 3, DIG. 18; 24/459; 72/372; 405/288, 302.1, 302.2, 259.1, 259.4, 259.5, 259.6; 470/13, 16, 33

[56] References Cited

U.S. PATENT DOCUMENTS

| | | | |
|---|---|---|---|
| 1,656,929 | 1/1928 | Whitney | 29/DIG. 18 X |
| 2,667,037 | 1/1954 | Thomas et al. | 61/45 |
| 3,357,084 | 12/1967 | Colautti et al. | 29/DIG. 18 X |
| 3,427,811 | 2/1969 | White | 61/45 |
| 3,505,824 | 4/1970 | White | 61/45 |
| 3,509,726 | 5/1970 | White | 61/45 |
| 4,274,762 | 6/1981 | Johnson | 405/259 |
| 4,349,300 | 9/1982 | Kelley | 405/288 |
| 4,395,161 | 7/1983 | Wilson et al. | 405/259 |
| 4,498,816 | 2/1985 | Korpela et al. | 405/259 |
| 4,518,282 | 5/1985 | Wilcox et al. | 405/302.1 |
| 4,596,496 | 6/1986 | Tyrell et al. | 405/288 |
| 4,601,616 | 7/1986 | Barish et al. | 405/288 |
| 4,630,974 | 12/1986 | Sherman | 405/288 |
| 4,665,593 | 5/1987 | Davies et al. | 24/459 |
| 4,749,310 | 6/1988 | White | 405/288 |
| 4,934,873 | 6/1990 | Calandra, Jr. | 405/288 |
| 5,026,217 | 6/1991 | Seegmiller | 405/288 |
| 5,176,473 | 1/1993 | Seegmiller | 405/288 |
| 5,232,311 | 8/1993 | Stankus | 405/259.5 |

OTHER PUBLICATIONS

"O-B Dead-End Hook", Ohio Brass Brochure, p. 118.3, Apr., 1977.

"Current Trends In Roof Truss Hardware", C. P. Mangelsdorf presented at the Second Conference On Ground Control in Mining, West Virginia University, Morgantown, W. Va., Jul. 19-21, 1982.

"Mine Controls Bad Roof With Trusses Bolted On Cycle", Ken Barish, *coal age*, pp. 62-66, May 1985.

*Primary Examiner*—Peter Vo

*Attorney, Agent, or Firm*—Webb Ziesenheim Bruening Logsdon Orkin & Hanson

[57] ABSTRACT

A pair of truss brackets are secured to the roof of an underground passage adjacent to opposing ribs of the passage. The truss brackets each include a roof engaging surface and a truss supporting arm member extending from the roof engaging surface. A pair of U-bolts are supported by the arm members of the truss brackets. Each arm member extends horizontally from the truss bracket to an enlarged end portion of the arm member. The U-bolt is horizontally movable in a vertically hanging position on the arm member and is restrained by the enlarged end portion from disengagement from the arm member. The U-bolts are pivoted on the truss brackets to a horizontal position for connection to truss members which are connected to each other and tensioned to apply an uplifting force to the roof. As the truss members are connected and tensioned, the U-bolts are retained for a range of horizontal movement on the arm members to facilitate adjustments in the position of the U-bolts on the truss brackets.

9 Claims, 6 Drawing Sheets

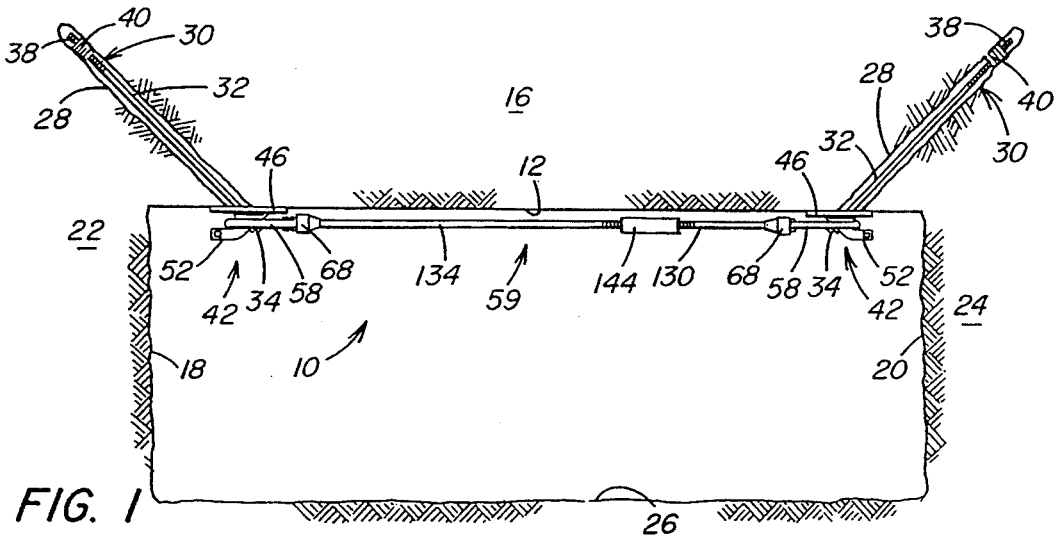
FIG. 1
FIG. 1A
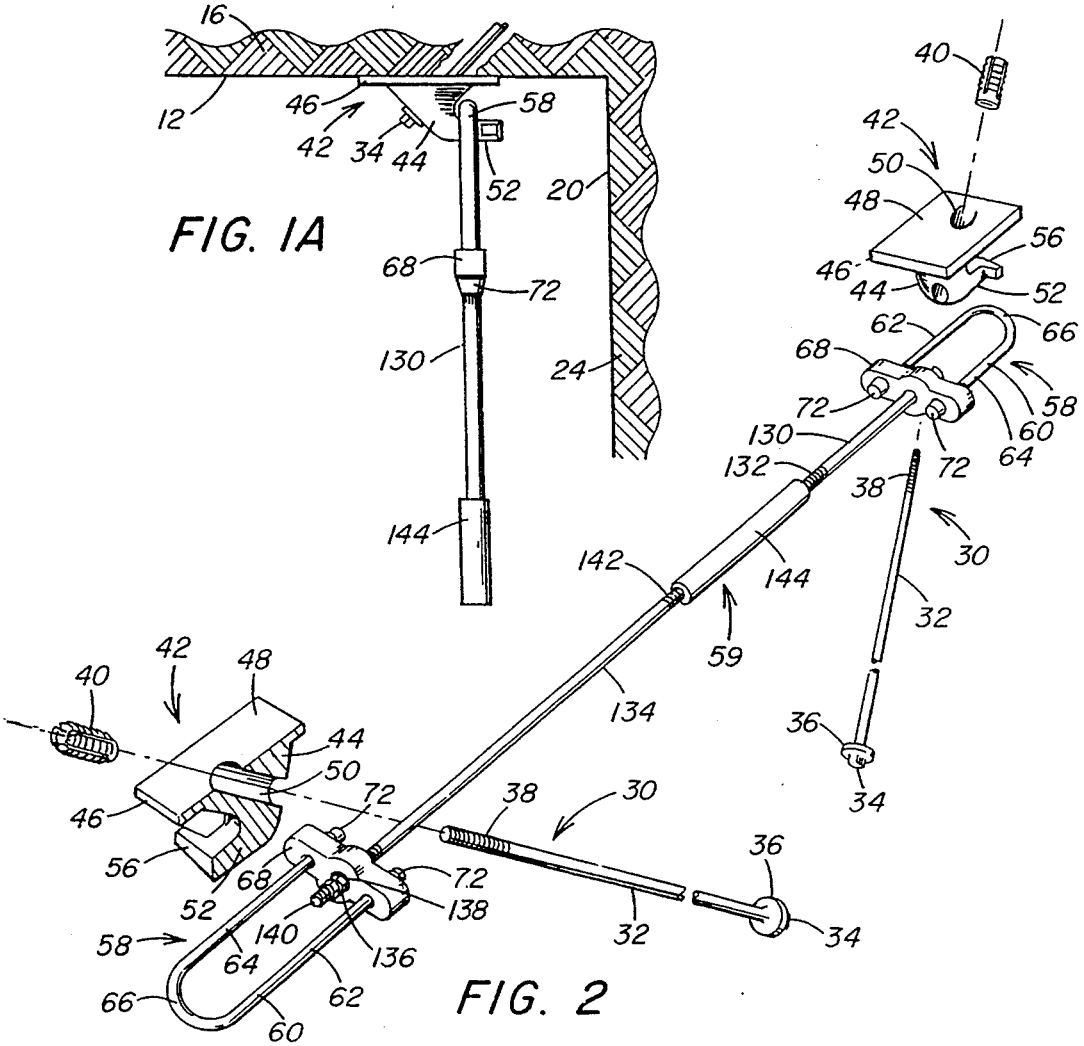
FIG. 2

METHOD FOR FABRICATING A TRUSS MEMBER FOR A MINE ROOF SUPPORT

CROSS REFERENCE TO RELATED APPLICATION

This application is a division of application Ser. No. 962,255, filed Oct. 16, 1992, entitled "Method And Apparatus For Supporting A Mine Roof" by Frank Calandra, Jr., et al. now U.S. Pat. No. 5,302,056.

BACKGROUND OF THE INVENTION

1. Field of the Invention

This invention relates to a mine roof support truss and, more particularly, to a truss system that is economically fabricated and efficiently installed to produce a desired tension for supporting a wide variety of mine roof conditions.

2. Description of the Prior Art

Truss-type mine roof supports are well known in the art of supporting the roof of an underground passageway, such as a mine passage. A basic truss system includes one or more rods extending horizontally the width of the mine passage adjacent the roof and connected at their ends to anchor bolts which extend at an angle adjacent the ribs of the passageway into the rock strata over a solid pillar. The rods are tensioned and vertical components of compressive forces are transmitted into the solid material over the pillars as opposed to the unsupported rock material immediately above the passageway.

With this arrangement, a truss system shifts the weight of the rock strata from over the mined out passageway back onto the pillars. The desirability of truss systems has been enhanced by the development of roof bolting machines that can convert from vertical to angle drilling. Conventionally, holes are drilled into the mine roof at a 45° angle from the horizontal adjacent to the mine rib so that the holes extend into the supported rock structure of a pillar. To insure adequate anchorage over the pillar at the ribline, the bolts extend up to six or seven feet into the supported structure of the pillar.

Once the angle holes are drilled into the strata over the pillars at the ribline, anchor bolts are inserted in the drilled holes and are secured in place using mechanical expansion shell assemblies in combination with resin. This arrangement insures adequate anchorage over the ribline for bolts that extend in length up to six or seven feet. Before the bolts are inserted in the drilled holes, truss shoes or bearing blocks are positioned on the bolt at the emergent end of the bolt from the hole. As the bolts are securely anchored in the bore holes, the bearing surfaces of the truss shoes or bearing blocks are compressed into engagement with the mine roof.

For an uneven mine roof or a roof having severely potted areas, the truss shoe or bearing block must have a sufficient bearing surface to contact the mine roof so that the plate does not slip and the truss shoe is correctly positioned for engagement with the horizontal truss members. Once the truss shoes or bearing blocks are securely positioned at the mine roof adjacent the ribs, the horizontal truss members are assembled and connected to the truss shoes. The truss members are tightened to a preselected torque to exert tension on the truss members so that the weight of the rock strata over the mined out area beneath the roof is shifted along the horizontal truss members upwardly into the solid rock strata over the pillars at the ribline.

A wide variety of truss hardware is commercially available to form a truss system between the anchored angle bolts. The truss hardware is connected under tension to the truss shoes or bearing blocks that are held tightly against the mine roof by the anchored angle bolts.

U.S. Pat. Nos. 4,601,616 and 4,630,974 are examples of mine roof truss systems that utilize L-shaped bearing plates for connecting the horizontal truss members to the anchored angle bolts. The bearing plates include a horizontal member that bears against the mine roof and receives the anchor bolt. A vertically depending portion of the plate has a transversely extending opening through which a tie rod or cord of the truss extends. An enlarged bolt head abuts the vertically depending portion, and the ends of the tie rod extending from the bearing plates are coupled together. A preselected torque is applied to the coupled ends of the tie rods to create the desired degree of tension in the truss system.

The above described truss system connects the coupled truss members to the bearing plates and requires that the truss members be extended through holes in the bearing plates and secured thereto by nuts threaded onto the ends of the truss members. The bearing plates are positioned closely adjacent the ribline which may provide insufficient space to extend the elongated rods through the holes. Consequently, the truss members may be required to be connected to the bearing plates before the plates are anchored to the passage roof. This can be a time consuming and difficult task.

An alternate approach to connecting truss hardware to anchored truss shoes or bearing plates is disclosed in U.S. Pat. No. 4,934,873 in which the roof anchor has an eye-bolt forged on the end of the roof anchor. A U-bolt passes through the eye of the bolt head and is then bolted to a retainer or block member that extends transversely between the legs of the U-bolt. An elongated tension bolt having an enlarged head at one end and a threaded end at the opposite passes through the header of one U-bolt so that the enlarged head abuts the header. The opposite threaded end of the tension bolt passes through the U-bolt header at the opposite rib and receives a nut which is threaded onto the tension bolt. By tightening the tension bolt through the nut on the threaded end, the eye-bolt ends of the anchor bolts are drawn toward one another to place the truss members in tension and support the mine roof. The truss members are securely connected to one another as well as to the anchored eye-bolt ends.

Truss systems have also been proposed to facilitate ease of assembly and disassembly of the truss hardware to the anchored truss shoes without requiring that the truss hardware be connected to the truss shoes before they are positioned at the mine roof. U.S. Pat. Nos. 4,596,496 and 5,026,217 disclose truss shoes having a J-shaped lip that receives the closed or arcuate end of a U-bolt. The J-shaped lip of the truss shoe includes a recess for receiving the end of the U-bolt. This facilitates ease of assembly and disassembly of the U-bolt on the truss shoe without requiring the U-bolt to be threadedly connected to the shoe or extended through an opening in the shoe. The end of the U-bolt is looped onto the recess and is permitted to hang freely downwardly on the shoe and then pivoted upwardly into a horizontal position for connection of the truss members. However, the U-bolt is not securely connected to the truss shoe until it is placed in tension. When the connected truss members are tensioned, the U-bolts are drawn together and securely retained on the truss shoes. When the U-bolts are released from connection, the bolts can be pivoted downwardly to hang from the truss shoes. However, if the truss shoes are inclined from the horizontal due to an uneven roof or the tension on the bolts is reduced or the bolts shift horizontally beyond the bearing surface of the J-shaped lip, the U-bolts can fall from the shoes. Therefore, measures must be taken to hold the U-bolts on the shoes before they are swung into a horizontal position. Then, once in the horizontal position, the required tension must be maintained on the bolts to prevent their horizontal shifting.

While it has been proposed to securely connect truss members to truss shoes so that the truss members will not be displaced and can be vertically retained preliminarily to connection and tensioning, the mechanical connections required to secure the truss members to the shoes necessitate additional hardware and time of installation. On the other hand, for truss shoes having a J-shaped lip, while the U-bolts are easily looped into position on the truss shoes, the U-bolts can become displaced from the truss shoes unless sufficient tension is maintained on the U-bolts to retain them secured to the truss shoes.

Therefore, there is need for a truss system that permits ease of installation of U-bolts to truss shoes and also provides means for efficiently retaining the U-bolts on the truss shoes in both a vertically hanging position and a horizontal position as well. In order to facilitate connection of the truss shoes to the truss members and permit adjustment in the length of the connected truss members for mounting on the truss shoes, the U-bolts must be retained for horizontal movement on the truss shoes. This arrangement would serve to decrease the installation time of the truss. It would then be possible to install a truss system on-cycle with the mining operation, particularly when the roof control plan specifies that trusses be installed on centers as close as one foot.

SUMMARY OF THE INVENTION

In accordance with the present invention there is provided a roof support for an underground passage that includes first and second truss brackets. Means is provided for securing the first and second truss brackets to the roof of an underground passage adjacent to opposing ribs of the passage. The truss brackets each include a roof engaging surface for positioning in contact with the roof and a truss supporting arm member extending from the roof engaging surface. The truss supporting arm member is positioned horizontally relative to the roof engaging surface. Truss means extend between the first and second truss brackets for applying an uplifting force to the roof to support the roof above the passage. The truss means include a pair of U-shaped members releasably engaged to the first and second truss brackets. Each of the U-shaped members is supported in a vertically hanging position by the supporting arm members. The arm members each include an end portion having means for retaining the U-shaped member for horizontal movement on the truss bracket. Further, means is provided for applying tension to the truss members with the U-shaped members engaged to the truss brackets to apply an uplifting force to the roof.

Further, in accordance with the present invention there is provided a method for supporting the roof of underground passage comprising the steps of securing a pair of truss brackets to the roof of an underground passage adjacent to opposing ribs of the passage. A truss member is positioned between the pair of truss shoes. A pair of U-shaped members extend from opposite ends of the truss member toward the pair of brackets. The U-shaped members are positioned on receiving surfaces of the truss brackets. The U-shaped members are supported for relative horizontal movement on the receiving surfaces. The U-shaped members are restrained from being displaced from the receiving surfaces of the truss brackets in both a vertically hanging and a horizontally extending position of the U-shaped members on the truss brackets. The truss member secured to the truss bracket is tensioned to apply a uplifting force to the roof to support the roof of the underground passage.

Additionally, the present invention relates to a truss bracket for a roof support of an underground passage that includes a unitary body portion having a base member with a substantially horizontally positioned bearing surface. The body portion depends downwardly from the base member. The body portion has a bore extending through the bearing surface for receiving a roof bolt. A truss supporting arm member extends from the body portion. The truss supporting arm member includes a longitudinally extending surface for receiving a truss member. The longitudinally extending surface terminates in a laterally extending enlarged end portion. The laterally extending enlarged end portion retains the truss member for horizontal movement on the supporting arm and in a vertically hanging position on the supporting arm.

Additionally, in accordance with the present invention there is provided a truss member for a mine roof support that includes a U-shaped rod member having a pair of end portions positioned in spaced parallel relationship. An intermediate portion connects the end portions. The intermediate portion has an arcuate section positioned remote from the end portions. A holder having a pair of bores therethrough receives the pair of rod member end portions to permit the holder to move freely along the length of the rod member between the end portions and the arcuate section. Retention means is formed integral with the rod member end portions for preventing the holder from being removed from the rod member.

Further, the present invention includes a process for fabricating a truss member for a mine roof support comprising the steps of bending an elongated rod member into a U-shape to form a pair of end portions positioned in spaced parallel relationship and integrally connected by an arcuate section longitudinally spaced from the end portions. The rod member end portions extend through a pair of holes in a block member. The block member is moved to a preselected position on the rod member spaced from the end portions. The end portions of the rod member are forged to form obstructions thereon to retain the block member on the rod member for movement between the obstructions and the arcuate section.

Accordingly, a principal object of the present invention is to provide method and apparatus for the rapid installation of a economical truss system for supporting the roof of an underground passage.

Another object of the present invention is to provide a truss system that utilizes U-bolts for connecting a truss to truss brackets bearing against the uneven surface of a mine roof.

Another object of the present invention is to provide a truss bracket having a truss receiving portion to accommodate ease of installation and removal of the truss and permit horizontal movement of the truss, while retaining the truss on the truss bracket.

A further object of the present invention is to provide a U-bolt for a mine roof truss in which the U-bolt is economically fabricated for ease of installation in a truss system.

These and other objects of the present invention will be more completely disclosed and described in the following specification, the accompanying drawings, and the appended claims.

BRIEF DESCRIPTION OF THE DRAWINGS

FIG. 1 is a sectional view in side elevational of an underground passage, illustrating a truss system extending the width of the passage and anchored by roof bolts extending at an angle into the solid material above the side walls of the passageway.

FIG. 1A is an enlarged, fragmentary sectional view of the underground passage at a side wall, illustrating a component of the truss system retained in a vertically hanging position on a truss bracket.

FIG. 2 is an exploded isometric view, partially in section, illustrating the components of the roof truss system.

DESCRIPTION OF THE PREFERRED EMBODIMENTS

Figure 3:
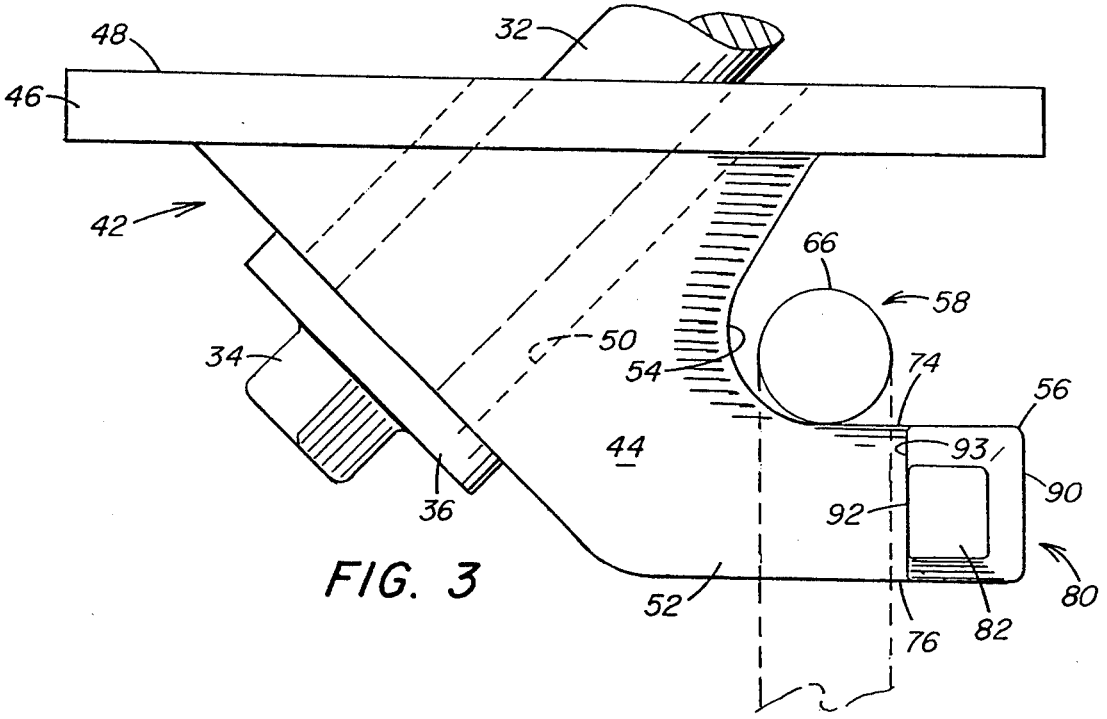
FIG. 3 is an enlarged fragmentary elevational view, partially in section of a truss bracket, illustrating a U-bolt retained in a vertically hanging position on the bracket.

Referring to the drawings and particularly to FIGS. 1 and 2 there is illustrated a truss system generally designated by the numeral 10 for supporting a roof 12 above an underground passageway 14 cut in a rock formation 16 by conventional mining methods to extract solid material, such as coal, therefrom in a mining operation. The passageway 14 is defined by oppositely positioned side walls 18 and 20 formed by ribs or pillars 22 and 24 that extend between the roof 12 and a floor 26. The portion of the rock formation 16 above the roof 12 is unsupported. The truss system 10 is installed transversely across the passage 14 adjacent the roof 12 to provide an uplifting force through the unsupported roof 12 in a manner which will be described later in greater detail by which the weight of the rock formation 16 above the roof 12 is shifted horizontally and redirected to the rock formation supported by the pillars 22 and 24.

Truss system 10 is secured to the mine roof 12 by roof bolts inserted in holes drilled at an angle, preferably 45°, through the surface of the roof 12 and a preselected length into the rock formation which is supported by the solid pillars or ribs 22 and 24. In one example, bore holes 28 are drilled at a 45° angle a distance of six to seven feet into the mine roof from points spaced approximately two feet from the respective side walls 18 and 20 to end points supported by solid material above the pillars 22 and 24.

A suitable roof bolt assembly 30 for use with the present invention includes an elongated roof bolt 32 having an enlarged head 34 with a washer 36 at one end and an opposite threaded end portion 38. A mechanical expansion shell assembly generally designated by the numeral 40 is threadedly engaged to the bolt end portion 38. As well known, upon rotation of the roof bolt assembly 30, the shell assembly 40 is expanded into gripping engagement with the wall of the bore hole to exert tension on the bolt 32 with the end portion 34 bearing against the mine roof 12. To increase the anchorage of a roof bolt assembly 30 within the bore hole 28, resin can be used in combination with the roof bolt assembly 30 when it is installed. The use of resin adds additional strength to the anchorage of the bolt 32 in the bore hole 28 when a torque is applied to the end portion 34.

Prior to installation of the roof bolt assembly 30 in the bore hole 28, a truss bracket or bearing block generally designated by the numeral 42 of the truss system 10 is positioned on the roof bolt 32 at the end portion 34. The truss bracket 42 includes, as seen in greater detail in FIGS. 3–5, a unitary body portion 44 having a base member 46 with a bearing surface 48 for engaging the mine roof. The body portion 44 depends downwardly from the base member 46 and a bore 50 extends at an angle through the body portion 44 and the base member 46.

The roof bolt 32 is advanced through the bore 50 of the truss bracket 42. Then the expansion shell assembly 40 is threaded onto the bolt end portion 38. The roof bolt 32 is then inserted upwardly into the angled bore hole 28 in the rock formation 16. The roof bolt assembly 30 is advanced into the bore hole 28 so that the enlarged end portion 34 contacts the truss bracket body portion 44 to urge the plate bearing surface 48 into contact with the roof 12. When the bearing surface 48 is satisfactorily seated in contact with the roof 12, a torque is applied to the bolt end portion 34 to expand the shell assembly 40 to anchor the bolt 32 in the bore hole 28.

In many underground passageways or excavations, the surface of the roof 12 may be very uneven or exhibit severe potted areas formed during the excavation operation. Therefore, it is important that the truss bracket 42 have a bearing surface 48 of a sufficient area to prevent the base member 46 from becoming distorted or pulled into a recess in the roof 16 when the bolt 32 is tensioned. While the truss bracket 42 is shown with the base member 46 in a substantially horizontal position in FIG. 1, it should be understood that it is not uncommon for the truss bracket to be substantially inclined or displaced from the preferred horizontal position. As will be explained later in greater detail, the construction of the truss bracket 42 of the present invention assures successful installation of the truss system 10 for a wide variety of roof conditions.

A truss supporting arm member 52 extends outwardly from the truss body portion 44. The arm member 52 is positioned horizontally relative to the bracket bearing surface 48. The truss body portion 44 and arm member 52 form an abutment wall 54 having an arcuate configuration for receiving the end portions of the truss system 10 that extends horizontally between the pair of truss brackets 42. The arm member 52 includes an end portion 56 having a configuration particularly adapted to support the end of a U-bolt or stirrup generally designated by the numeral 58. The U-bolt 58 is shown supported in a vertically hanging position on the arm member 52 in FIGS. 3 and 4. The U-bolt 58 is shown in a horizontal position on the arm member 52 in FIG. 5.

As will be explained later in greater detail the construction of the arm member 52 facilitates initial positioning of the U-bolt 58 to hang vertically on the arm member. Then when the U-bolts 58 are connected to the truss system 10 they extend horizontally. The arm member 52 having the end portion 56 retains the U-bolt 58 on the truss bracket 42. In a horizontal position the U-bolt 58 can move horizontally on the arm member 52 without becoming disengaged from the truss bracket 42.

With this arrangement, horizontal shifting movement of the U-bolt 58 on the arm member 52 is permitted during installation of the truss system 10. Furthermore, once the truss system 10 is installed, if a force is applied to the truss system 10 causing the U-bolts 58 to move or shift horizontally, the arm members 52 will prevent the U-bolts 58 from becoming disengaged from the truss brackets 42.

The U-bolt 58 is connected to a tie rod assembly generally designated by the numeral 59. With the tie rod assembly 59 securely connected to the U-bolts 58 mounted on the truss brackets 42, the tie rod assembly 59 is placed in tension so that the weight of the unsupported rock formation 16 above the passage 14 is transferred upwardly and back over the portion of the rock formation 16 supported by the solid pillars 22 and 24. Thus, the tensioned truss system 10 applies an uplifting force to the roof 16 to support the roof 16 over the passage 14.

Figure 10:
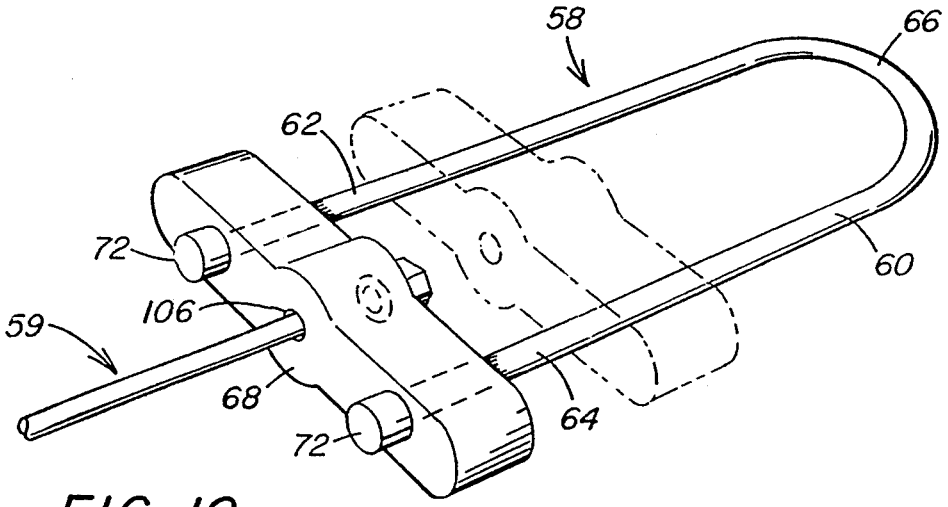
FIG. 10 is a fragmentary, isometric view of a U-bolt having forged ends for slidably retaining a holder on the U-bolt for receiving the end of a torquing bolt of the roof truss.

As shown in detail in FIG. 10, the U-bolt 58 includes a rod member 60 bent in a substantial U-shape having end portions 62 and 64 positioned in spaced parallel relation. An intermediate portion 66 having an arcuate section is positioned remote from the end portions 62 and 64. A holder or retainer 68 for the tie rod assembly 59 is positioned on the U-bolt end portions 62 and 64.

Preferably, the holder 68 is longitudinally slidable on the U-bolt end portions 62 and 64 to facilitate insertion and removal of the ends of the tie rod assembly 59 with respect to the holder 68. The holder 68 includes a pair of bores for receiving the U-bolt end portions 62 and 64. Preferably, the diameter of the bores in the holder 68 is greater than the diameter of the U-bolt end portions 62 and 64 so that the holder 68 is free to move along the length of the U-bolt and can be adjusted in position on the U-bolt 58 for connection to the end of the tie rod assembly 59.

To retain the slidable holder 68 on the U-bolt 58, the extreme ends of the end portions 62 and 64 are provided with caps 72, as shown in detail in FIG. 10. Preferably, the caps 72 are formed integral with the end portions 62 and 64 as opposed to using nuts engageable with threaded end portions of the U-bolt. By forming the caps 72 integral with the end portions 62 and 64, the associated expense of threading the end portions 62 and 64 and utilizing nuts is avoided.

In accordance with the present invention, the caps 72 are formed integral with the end portions 62 and 64 by forging the end portions 62 and 64 in a conventional forging operation so as to form the enlarged ends 72. This is accomplished initially by bending a rod into the configuration of the U-shaped rod member 60 having the end portions 62 and 64 of uniform diameter. The holder 68 having the bores 70 therein is advanced onto the U-shaped bolt so that the end portions 62 and 64 extend through the holder 68. With the holder 68 positioned on the U-bolt 60, the end portions 62 and 64 are then hot forged to form the enlarged caps 72. In this manner, the holder 68 is permanently retained on the U-bolt but it is free to move along the length thereof to facilitate adjustments in the position of the holder to receive the tie rod assembly 59.

Figure 4:
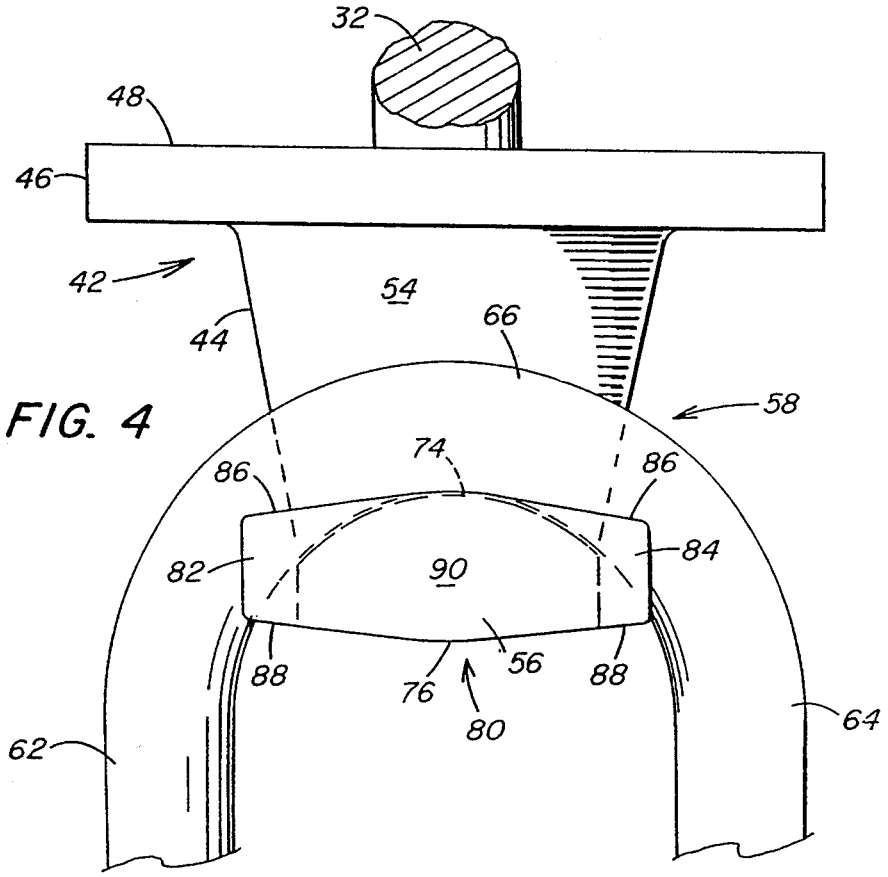
FIG. 4 is a front elevational view of the truss bracket shown in FIG. 3, illustrating a portion of the vertically hanging U-bolt.
Figure 5:
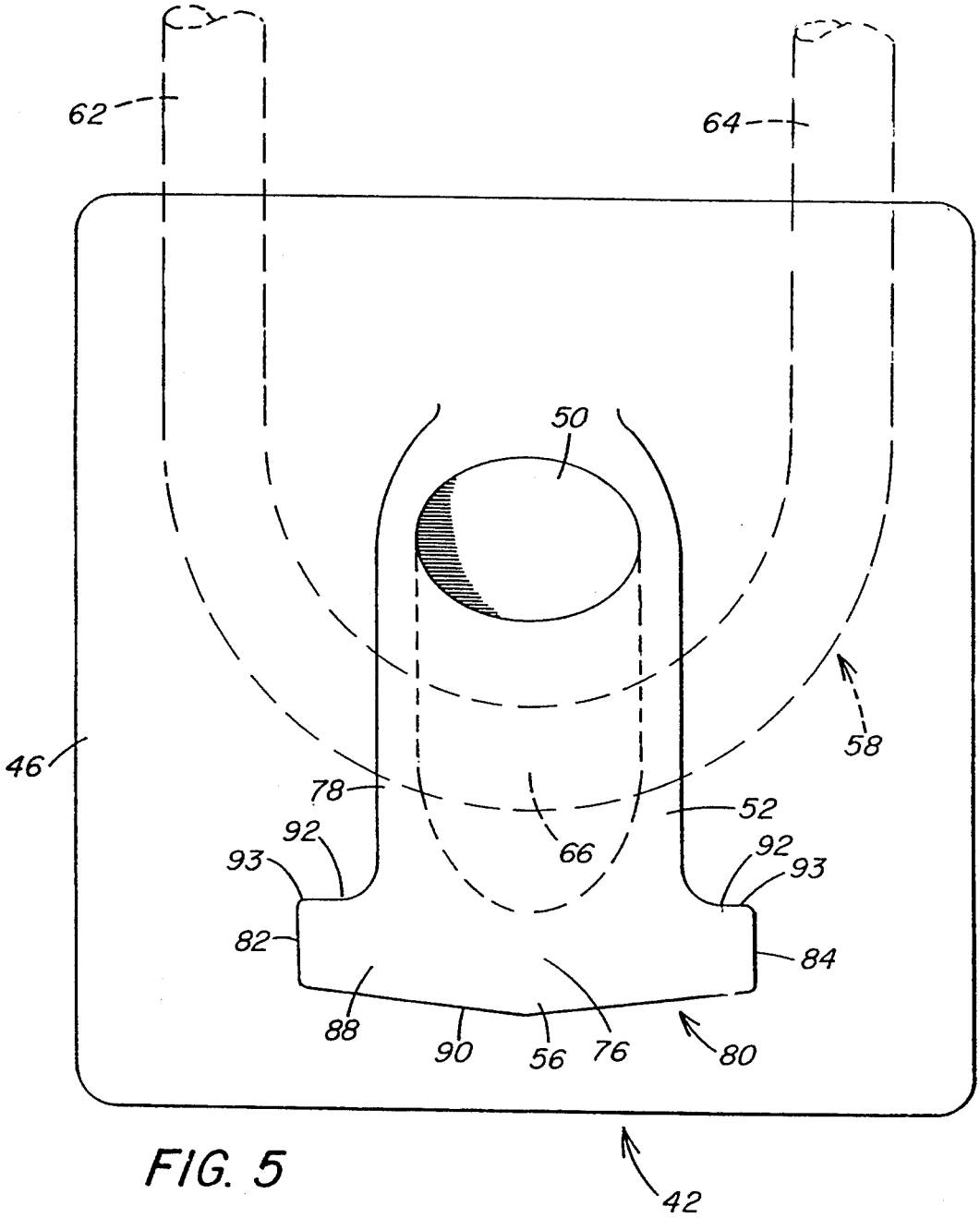
FIG. 5 is a bottom plane view of the truss bracket shown in FIGS. 3 and 4, illustrating in phantom the U-bolt in a horizontal position.

As shown in FIG. 5, the intermediate portion 66 of the U-bolt 58 is initially extended around the body portion 44 of the truss bracket 42 into abutting relation with the wall 54. With the bracket base member 46 in a horizontal position, the U-bolt 58 can hang vertically, as shown in FIGS. 3 and 4, on the arm member 52 with the U-bolt end portions 62 and 64 extending downwardly from opposite sides of the arm member 52, as shown in FIG. 4. The U-bolt 58 is transported on the truss bracket 52 in this manner to the installation site, as well as, initially hung from the truss bracket 42 when bracket 42 is anchored to the mine roof. Thereafter, the end portions 62 and 64 are swung upwardly from a vertical position and pass on opposite sides of the bracket body portion 44, as shown in FIG. 5, for connection to the tie rod assembly 59. With the U-bolt 58 horizontally positioned on the bracket 42, the holder 68 is positioned on the opposite side of the bracket body portion 44 for connection to the tie rod assembly 59.

The U-bolt 58 is swung from the vertical position, shown in FIGS. 3 and 4, to the horizontal position, shown in FIG. 5, to connect the holder 68 to the tie rod assembly 59. Tensioning the tie rod assembly 59 firmly secures the U-bolt 58 to the truss bracket 42. To facilitate retention of the U-bolt 58 on the truss bracket 42 prior to tensioning, the bracket arm member 52 includes the end portion 56 having an expanded construction which permits horizontal movement of the U-bolt 58 on the arm member 52 without becoming disengaged therefrom. The arm member end portion 56 has a configuration which prevents the U-bolt 58 from becoming disengaged from the bracket 42 once the U-bolt 58 is positioned on the bracket, as shown in FIGS. 3 and 4 and then moved to a horizontal position for connection to the tie rod assembly 59. Furthermore, as long as the bracket 42 is maintained substantially horizontal, the U-bolt 58 hanging freely in a vertical position will not slip off of the bracket arm member 52 by provision of the enlarged end portion 56.

While, the U-bolt 58 can not be disengaged from the arm member 52 once it is positioned on the bracket 42 and connected to one of the components of the tie rod assembly 59, the U-bolt 58 is permitted to move horizontally on the arm member 52 without falling therefrom. This permits adjustments to be made in the positioning of the U-bolt 58 on the arm member 52 for connection to the tie rod assembly 59. The U-bolt 58 can be moved horizontally on the arm member 52 to allow adjustment in the length of the tie rod assembly 59 so that the ends thereof can be connected to the U-bolts 58 on the oppositely positioned brackets 42. Also, once the truss system 10 is installed and in the event of a lateral shift in the tie rod assembly 59, caused for example by a piece of operating equipment impacting the truss system 10, the impact force can be taken up by horizontal movement of the U-bolt 58 on the arm member 52. The U-bolt 58 is neither restrained from moving horizontally on the bracket arm member 52 nor disengaged therefrom when it moves horizontally on the arm member 52.

Now referring to FIGS. 3–5, there is illustrated in detail the truss bracket 42 having the arm member 52 extending substantially horizontally outwardly from the bracket body portion 44. The arm member 52 is integrally connected to the body portion 44 and includes an upper surface 74 that extends in a horizontal plane from the abutment wall 54. A lower surface 76 of the arm member 52 extends outwardly from the body portion 44 parallel to the upper surface 74 to provide the arm member 52 with a substantially uniform thickness along its length. The thickness of the arm member 52 is sufficient to resist deflection under the weight of the U-bolt 58.

As seen in FIG. 5, the arm member 52 extends a preselected distance from the body portion 44 through an intermediate portion 78 to end portion 56. The end portion 56 expands in length transversely of the longitudinal axis of the arm member 52. With this arrangement, the width of the end portion 56 is substantially wider than the intermediate portion 78 of the arm member 52. The width of the arm member 52 is substantially uniform along the length of the arm member intermediate portion 78. At the end portion 56, the arm member 52 expands laterally to form a rail-like abutment member generally designated by the numeral 80.

The abutment member 80 extends perpendicular to the longitudinal axis of the arm member 52 and includes lateral end portions 82 and 84 that extend transversely of the arm member 52 to form a T-shaped arm member 52. As seen in FIG. 4, the end portions 82 and 84 have a width that narrows outwardly from the point where the end portions 82 and 84 merge with the intermediate portion 78. The end portions 82 and 84 each include upper and lower surfaces 86 and 88 which are inclined relative to the horizontal plane of the arm member surfaces 74 and 76. At the merge point of the end portions 82 and 84 with arm member intermediate portion 78, the surfaces 86 and 88 lie in the horizontal plane of the surfaces 74 and 76, respectively as seen in FIG. 3. Thus, a continuous horizontal surface extends outwardly from truss bracket body portion 44 along the arm member 52 to the abutment member 80.

Further as seen in FIG. 3, the abutment member 80 of the arm member 52 includes a front vertical wall 90 and a rear vertical wall 92. The front vertical wall 90 extends the length of the arm member end portion 52. The rear vertical wall 92 is divided into two portions on opposite sides of the arm member intermediate portion 78, forming upper abutment shoulders 93 as seen in FIGS. 3 and 5. As seen in FIG. 4, the length of the abutment member 80 exceeds the width or span between the U-bolt end portions 62 and 64 at the point where the end portions 62 and 64 join the arcuately shaped intermediate portion 66 of the U-bolt 58.

Thus, with the arrangement as seen in FIG. 4, when the U-bolt 58 is in a vertically hanging position on the arm member 52 and retained on the upper surface 74 between the abutment wall 54 and the abutment member 80, the end portions 82 and 84 are positioned oppositely of the juncture of the U-bolt end portions 62 and 64 with the intermediate portion 66. When the vertically hanging U-bolt 58 is advanced horizontally on the arm member 52 toward the abutment member 80, the U-bolt 58 contacts the abutment shoulders 93 and is restrained from further movement thereon. Accordingly, horizontal movement of the vertically hanging U-bolt 58 on the arm member 52 is permitted between the abutment wall 54 and the rear vertical wall 92 of abutment member 80.

With reference to FIG. 3, the U-bolt 58 can move on the arm member 52 to the left until it contacts the abutment wall 54 and to the right until it contacts the shoulders 93 on the rear vertical wall 92. The abutment wall 54 and the rear vertical wall 92 limit the range of horizontal movement of the vertically hanging U-bolt 58 on the arm member 52.

The vertically hanging U-bolt 58 can not advance beyond the abutment wall 54 on one side and can not advance beyond the rear vertical wall 92 on the opposite side. The abutment wall 54 contacts the bolt intermediate portion 66 and the rear vertical wall 92 abuts the bolt end portions 62 and 64. Thus, while the U-bolt 58 has a limited range of horizontal movement on the arm member 52, it will not slide off the arm member end portion 56. The shoulder 93 on the rear vertical wall 92 obstruct or block the U-bolt 58 from moving on the upper surface 74 beyond the abutment member 80.

When the U-bolt 58 is moved from the vertically hanging position shown in FIGS. 3 and 4 to the horizontal position shown in FIG. 5, the truss bracket arm member 52 continues to support the U-bolt 58. Furthermore, a limited range of horizontal movement of the U-bolt 58 in a horizontal position is permitted on the arm member 52 without the U-bolt 58 becoming disengaged from the truss bracket.

As seen in FIG. 5, the horizontally positioned U-bolt 58 is supported on the arm member 52 from the position where the bolt intermediate portion 66 abuts the abutment wall 54 to the position where the bolt end portions 62 and 64 are not supported by the abutment member 80. Once the U-bolt 58 in a horizontal position moves on the arm member 52 to the point where the distance between the bolt end portions 62 and 64 exceeds the width of the abutment member 80, the bolt end portions 62 and 64 will pass downwardly on opposite side of the abutment member end portions 82 and 84. This normally would occur only when the U-bolt 58 is disconnected from the remainder of the truss system 10.

When the oppositely positioned U-bolts 58 on truss brackets 42 are connected to the tie rod assembly 59 only an incremental range of horizontal movement of the U-bolts 58 occurs because the tie rod assembly is under tension. However, if an adjustment in the truss system is required necessitating a limited degree of horizontal movement of the U-bolts 58, the U-bolts 58 can move horizontally on the truss brackets 42 without becoming disengaged therefrom. This is permitted by the feature of the horizontally positioned arm member 52 having the end portion 56 of an expanded width.

Figure 9:
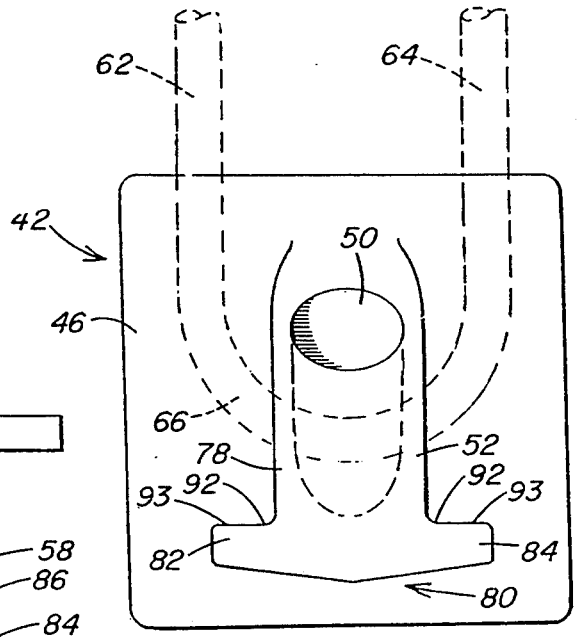
FIG. 9 is a bottom plan view of the truss bracket shown in FIG. 8, illustrating in phantom the U-bolt in an operative or horizontal position on the truss bracket.
Figure 8:
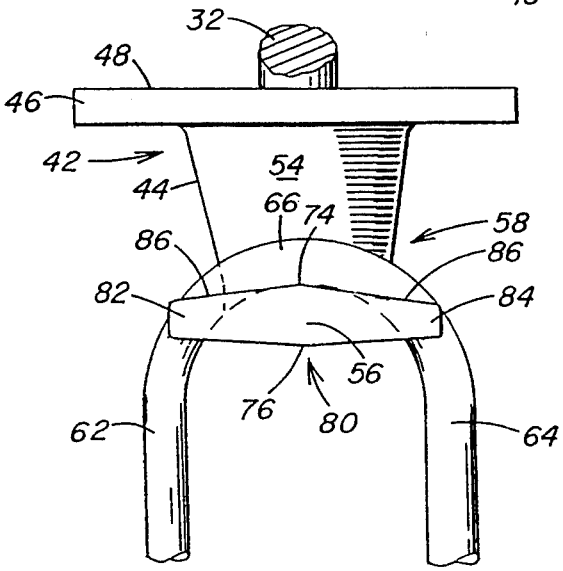
FIG. 8 is an end view of another embodiment of the truss bracket similar to FIG. 4, illustrating the U-bolt in vertically hanging position on the truss bracket.

The width of the end portion 56 of the arm member 52 is selective from the embodiment shown in FIGS. 3–5 to the embodiment shown in FIGS. 8 and 9 in which like elements are designated by like numerals shown in FIGS. 3–5. As seen in FIGS. 8 and 9, the enlarged end portion 56 of the arm member 52 has a width that exceeds the spacing between the U-bolt end portions 62 and 64. With this arrangement, the laterally extending end portions 82 and 84 of arm member end portion 56 remain in contact with the bolt end portions 62 and 64 along their entire length.

Thus, the bolt 58 when positioned horizontally, as shown in FIG. 9, is advanced horizontally on the surface of the arm member 52, the arm member end portions 82 and 84 are positioned in underlying relation with the bolt end portion 62 and 64 to support the U-bolt 58 on the member 52. The bolt 58 can not become disengaged from the arm member 52 by falling downwardly. Also, as seen in FIG. 8 for the vertically hanging U-bolt 58, the arm member end portion 56 blocks advancement of the U-bolt 58 on the arm member 52.

In the instance when the U-bolt 58 is disconnected from the holder 68, the U-bolt 58 is disengaged from the arm member 52 shown in FIG. 9 by passing the horizontally positioned U-bolt 58 on the arm member 52 to the point where the bolt free end portions 62 and 64 are removed from overlying relation with the laterally extending portions 82 and 84. However if the holder 68 is connected to the U-bolt 58, then the bolt 58 can not be removed from engagement with the truss bracket 42, shown in FIGS. 8 and 9, by horizontally moving the U-bolt 58 on the arm member 52. The enlarged abutment member 80 on the arm member 52 retains the U-bolt 58 on the arm member 52. Preferably, the U-bolt 58 is fabricated, as above described, to include the holder 68 permanently installed on the U-bolt 58.

Figure 6:
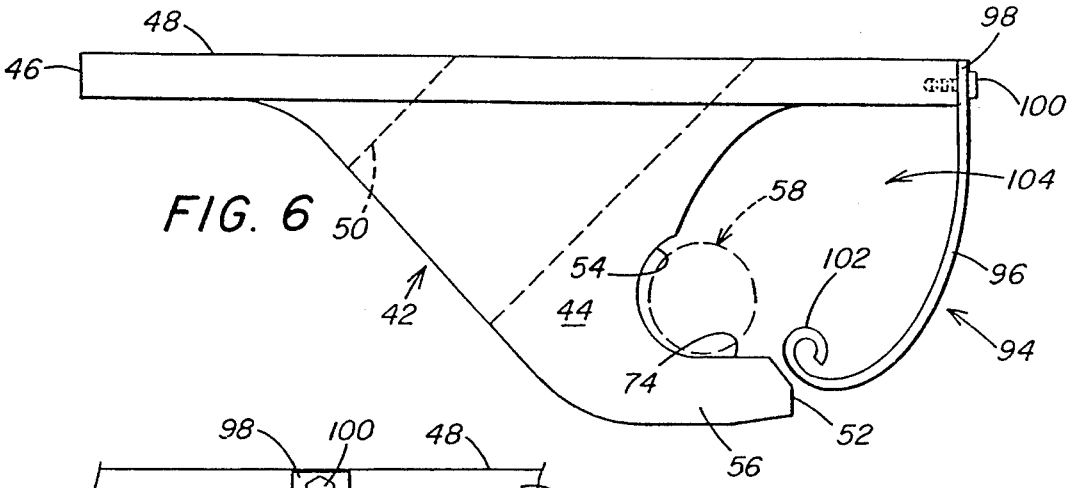
FIG. 6 is an elevational view of another embodiment of the truss bracket, illustrating a spring biased locking device for retaining the U-bolt in position on the bracket.
Figure 7:
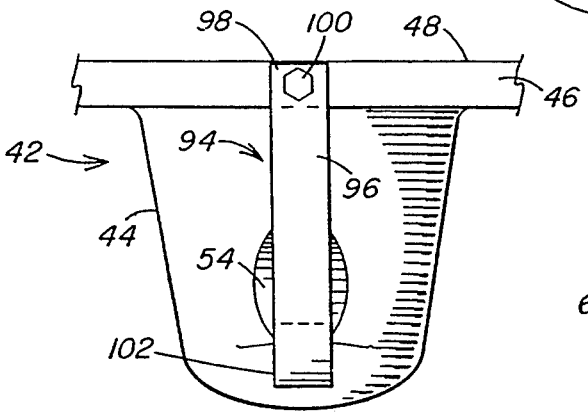
FIG. 7 is an end view of the truss bracket shown in FIG. 6.

Now referring to FIGS. 6 and 7, there is illustrated an additional embodiment of the truss bracket 42 in which like elements are designated by like numerals shown in FIGS. 3–5. The truss bracket 42 shown in FIGS. 6 and 7 includes a locking mechanism generally designated by the numeral 94 for connecting a truss bracket 42 to a U-bolt 58 so that the bracket and bolt can be handled as a unit rather than separately. This is particularly advantageous in transporting the bracket and bolt to a site for installation. However, the locking mechanism 94 is also operable to facilitate ease of removal of the U-bolt 58 from the truss bracket 42.

In the embodiment of the locking mechanism 94 shown in FIGS. 6 and 7, an arcuately shaped spring member 96, in the shape of a strap or the like, includes an end portion 98 connected by a fastener 100 to the end of the base member 46 which is positioned above the arm member 52. The spring strap 96 extends downwardly in an arcuate path toward end portion 56 of the arm member 52 and terminates in a coiled end portion 102. The coiled end portion 102 is spaced from but positioned closely adjacent to the bracket arm end portion 56. Also, the end portion 102 extends above the plane of the upper surface 74 of arm member 52. With this arrangement, the spring strap 96 forms with the arm member 56 and abutment wall 54, an enclosure generally designated by the numeral 104 for retaining the U-bolt 58 on the bracket 42 and preventing the U-bolt 58 from becoming disengaged from the bracket 42 once positioned on the arm member 52.

In accordance with one method of positioning the U-bolt 58 on the truss bracket 42, the spring strap 96 is urged upwardly to provide sufficient clearance for the U-bolt 58 to pass between the arm member end portion 52 and the coiled end portion 102. This can be accomplished by forcing the bolt intermediate portion 66 upwardly against the coiled end portion 102 to urge the coiled end portion 102 away from the arm member end portion 52 to provide sufficient space for the U-bolt 58 to pass between the arm member end portion 52 and the coiled end portion 102.

Once the end of the U-bolt 58 passes out of contact with the coiled end portion 102, the end portion 102 springs back to a locked position as shown in FIG. 6. The enclosure 104 is formed, preventing the U-bolt 66 from passing between the adjacent end portions 52 and 102. The U-bolt 58 is then positioned on the upper surface 74 of the arm member 52. The U-bolt 58 is retained on the arm member 52 to permit limited horizontal, as well as, vertical movement for adjustment purposes without becoming disengaged from the truss bracket 42.

Thus, the locking mechanism 94 retains the U-bolt 58 on the truss bracket 42 in a manner which permits a limited degree of movement of the U-bolt on the truss bracket. By provision of the locking mechanism 94, the U-bolt 58 can be easily moved into and out of a secure position on the truss bracket 42 either prior to installation of the truss bracket on the roof 12 or as the truss bracket is transported in the field to the site of installation. When the truss bracket 42 is anchored to the roof 12, the U-bolt 58 is moved into position on the bracket and secured in place on the receiving surface 74 by the action of the locking mechanism 94. The U-bolt 58 is retained on the truss bracket 42 for movement between horizontal and vertical positions to allow adjustments in the positioning of the U-bolt for connection to the end of the tie rod assembly 59.

Figure 11:
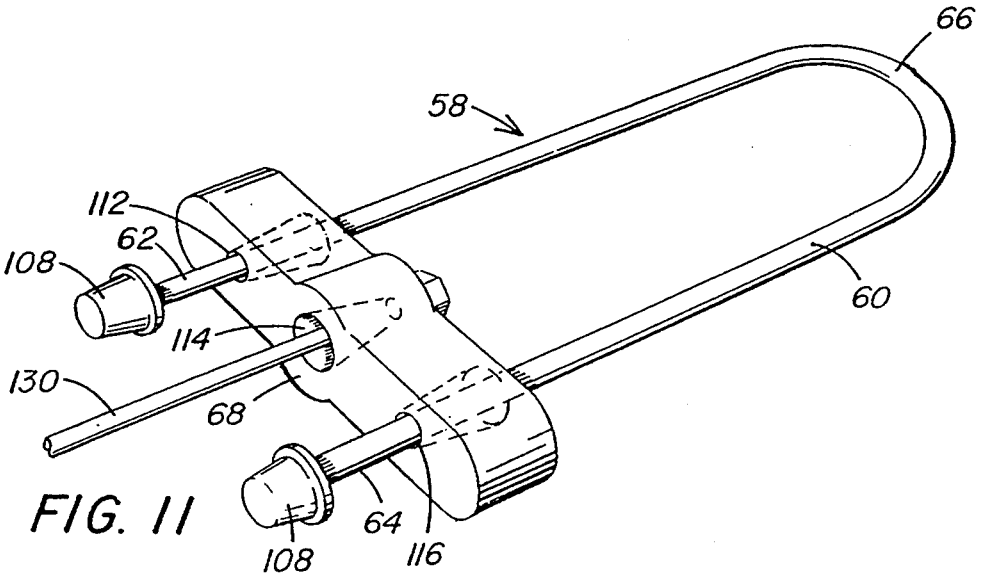
FIG. 11 is a fragmentary, isometric view similar to FIG. 10 of another embodiment of a U-bolt, illustrating forged ends having a tapered configuration on the U-bolt.

Now referring to FIGS. 10 and 11, the tie rod holder 68 on the U-bolt 58 includes a center or third bore for receiving the end of the tie rod assembly 59. The third hole or bore is centered between the bores through which the end portions 62 and 64 of the U-bolt extend. As illustrated in FIG. 10, a center bore 106 receives an end portion of the tie rod assembly 59.

Figure 12:
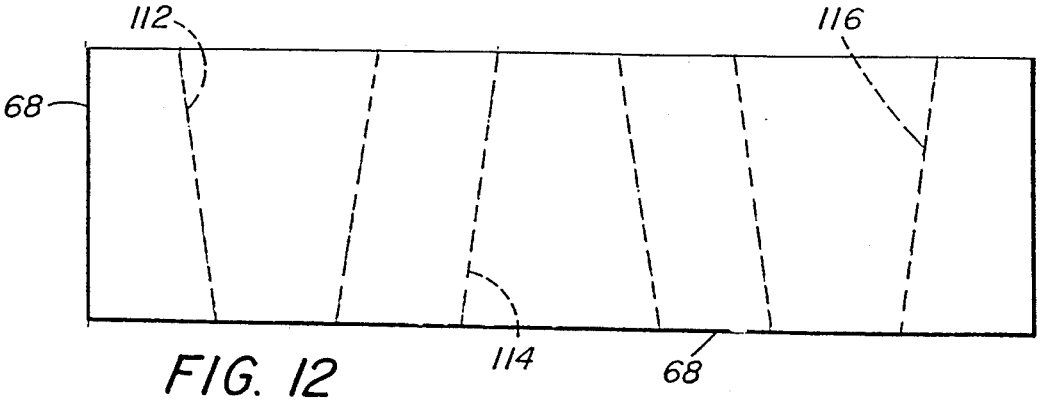
FIG. 12 is an enlarged plan view of the holder shown in FIG. 11, illustrating in phantom three tapered bores extending through the holder for receiving the ends of the U-bolt and the respective truss member.

With the embodiment of the U-bolt 58 shown in FIG. 11 bolt end portions 62 and 64 include integral forged ends 108 shaped in a conical configuration where the cross section of each end decreases toward the extreme end of the U-bolt. The holder 68 shown in FIG. 11 includes bores 112, 114, and 116 each having a conical configuration. The diameter of the conical bores 112 and 116 expands in a direction away from the forged ends 112 and 114. The conical bore 114 is positioned reverse to the bores 112 and 116. This arrangement is shown in greater detail in FIG. 12. The conical shaped bores 112, 114, and 116 in the holder 68 allow relative movement of the holder on the U-bolt 58 to facilitate adjustment in the positioning of the holder 68 on the U-bolt 58 when the U-bolt is connected to the tie rod assembly 59.

With both embodiments of the holder 68 shown in FIGS. 10 and 11, the holder 68 is initially positioned on the U-bolt end portions 62 and 64 before the enlarged end portions are forged on the U-bolt. With the bolt end portions 62 and 64 extending through the holder 68, the end portions are then forged in a desired shape to form the caps 72 shown in FIG. 10 or the caps 108 shown in FIG. 11. The caps 72 and 108 prevent disengagement of the holder 68 from the bolt 58. The holder 68 is movable along the length of the U-bolt 58, as shown in phantom in FIG. 10 and is retained on the bolt 58 without the requirement of a threaded connection on the ends of the U-bolt.

Figure 13:
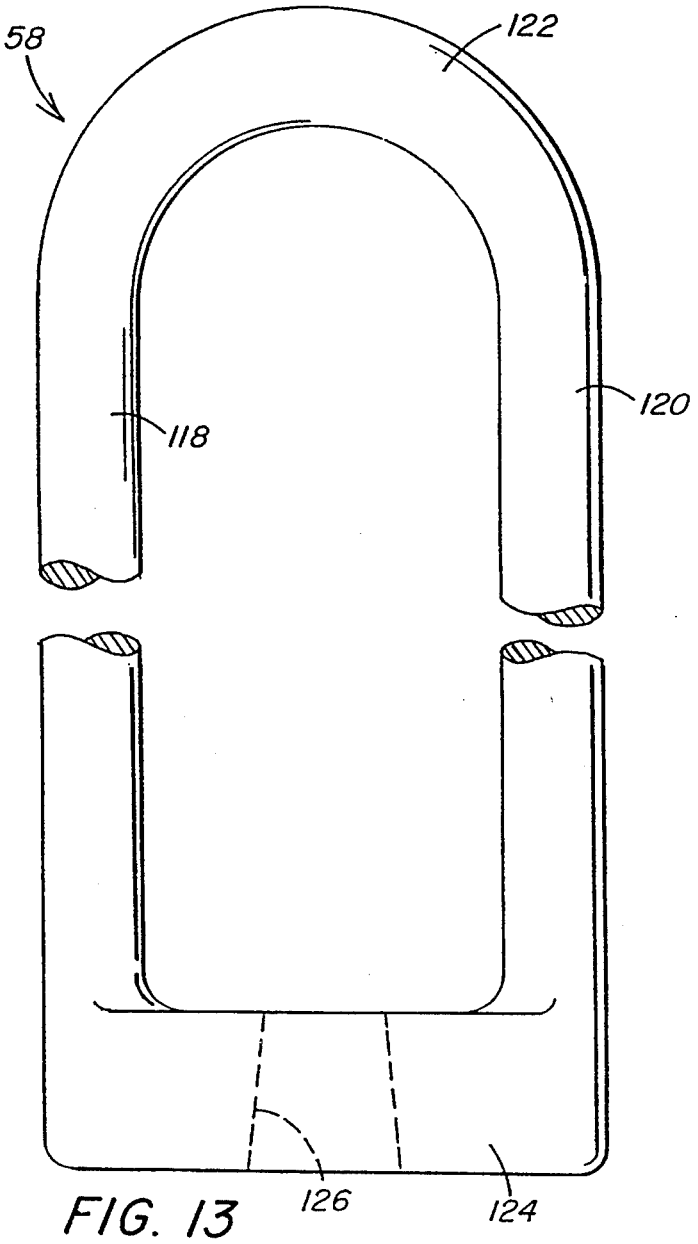
FIG. 13 is a fragmentary plan view of an another embodiment of a U-bolt having an integral holder.
Figure 15:
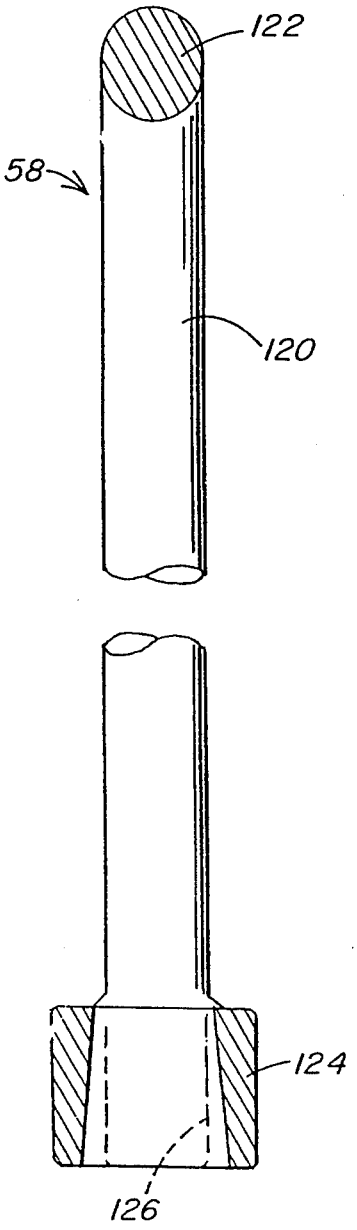
FIG. 15 is a fragmentary, partial sectional view in side elevation of the U-bolt shown in FIG. 13.
Figure 14:
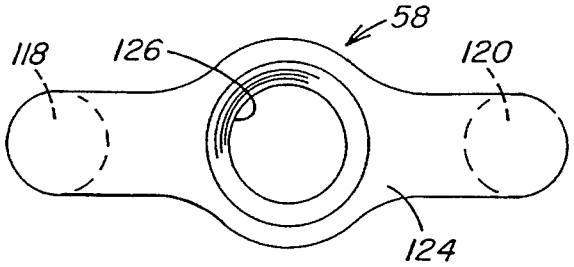
FIG. 14 is an end view of the U-bolt shown FIG. 13.

An additional embodiment of U-bolt 58 in accordance with the present invention is shown in FIGS. 13–15 in which the U-bolt 58 is a unitary structure that includes a pair of parallel spaced legs 118 and 120 connected at one end by an arcuate section 122 and at the opposite end by an integral holder 124. The integral holder 124 has a central bore 126 of a preselected configuration, such as a conical configuration, as shown in FIG. 13. The end of the tie rod assembly 59 extends through the bore 126. With this arrangement, a unitary structure of the U-bolt 58 is provided eliminating the need for separate assembly of a holder on the U-bolt 58.

Once the U-bolts 58 are positioned on the truss brackets 42 as illustrated in FIGS. 3, 6, or 8, the tie rod assembly 59 is connected to the mounted U-bolts 58. As shown in FIG. 1A, a torquing bolt 130 of a preselected length is advanced through the bore 106 in the holder 68 of the U-bolt 58 mounted adjacent to the rib 24. The torquing bolt 130 includes a threaded end portion 132 for receiving a coupler. A tie rod 134 of a preselected length is connected to the U-bolt 58 which is connected to the opposite truss bracket 42. The tie rod 134 includes a threaded end portion 140 which is advanced through the center bore 106 of the holder 68 for the U-bolt 58 positioned on the truss bracket 42 mounted adjacent to the opposite rib 22. The tie rod 134 is connected to the holder 68 by a pair of hex nuts 136 and washer 138 advanced on the threaded end portion 140 into contact with the U-bolt holder 168. The tie rod 134 includes an opposite threaded end 142 adapted for connection to a coupler 144 which is initially positioned on the threaded end portion 132 of the torquing bolt 130, as shown in FIG. 1A.

Once the tie rod 134 is connected to the U-bolt 68 mounted on the truss bracket 42 at side wall 22 and the torquing rod 130 is similarly connected to the truss bracket 42 at side wall 24, the tie rod 134 and torquing rod 130 are ready for connection to each other. The rods 130 and 134 are then moved to a horizontal position as the U-bolts 58 pivot on the truss brackets 42 to a substantially horizontal position. During this phase of installation, the U-bolts 58 are permitted to move horizontally on the truss brackets 42 without becoming disengaged therefrom, as above discussed. With the coupler 144 retained on the threaded end 132 of the torquing rod 130, the threaded end portion 142 of the tie rod 134 is advanced into the opposite internally threaded end of the coupler 144 to connect the tie rod 134 to the torquing rod 130 through the coupler 144. The torquing bolt 130 is then tightened to exert a preselected torque on the entire tie rod assembly 59. For example, the torquing bolt 130 is tightened to approximately 150–175 ft/lbs. Once the preselected torque is applied to the torquing bolt 130, the installation of the truss system 10 is completed.

Accordingly, to the provisions of the patent statutes, we have explained the principle, preferred construction and mode of operation of our invention and have illustrated and described what we now consider to represent its best embodiments. However, it should be understood, that within the scope of the appended claims, the invention may be practiced otherwise as specifically illustrated and described.

We claim:

1. A process for fabricating a truss member for a mine roof support comprising the steps of, bending an elongated rod member into a U-shape to form a pair of end portions positioned in spaced parallel relationship and integrally connected by an arcuate section longitudinally spaced from the end portions, extending the rod member end portions through a pair of holes in a block member, moving the block member to a preselected position on the rod member spaced from the end portions, and then forging the end portions of the rod member to form an obstruction thereon, the forged obstruction retaining the block member on the rod member for movement between the obstruction and the arcuate section.

2. A process as set forth in claim 1 which includes, forming the holes in the block member to exceed the diameter of the rod member end portions to permit movement of the block members relative to the rod member end portions.

3. A process as set forth in claim 1 which includes, forging the end portions of the rod member in a conical configuration where the cross section of the conical end portions decreases in a direction toward the extreme end of the rod member end portions.

4. A process for fabricating a truss member for a mine roof support comprising the steps of:

bending an elongated rod member into a U-shape to form a pair of end portions positioned in spaced parallel relationship and integrally connected by an arcuate section longitudinally spaced from the end portions, extending the rod member end portions through a pair of holes in a block member, moving the block member to a preselected position on the rod member spaced from the end portions, and forging the end portions of the rod member to form a conical obstruction thereon, to retain the block member on the rod member for movement between the obstruction and the arcuate section, wherein each of said conical obstructions having a conical configuration where the cross section of the conical end portions decreases in a direction toward the extreme end of the rod member end portions.

5. A process as set forth in claim 4 which includes, forming the pair of holes in the block member in a conical configuration where the diameter of each hole increases in a direction away from the conical end portions, and permitting movement of the block member on the rod member end portions while preventing disengagement of the block member from the rod member end portions.

6. A process as set forth in claim 5 which includes, extending a third hole through the block member positioned between the pair of conical holes in the block member for receiving the end of a tie rod assembly.

7. A process as set forth in claim 6 which includes, forming the third hole in the block member in a conical configuration where the diameter of the third hole increases in a direction opposite to the direction the pair of holes increase in diameter.

8. A process as set forth in claim 6 which includes, extending the end of the tie rod assembly through the third hole, and retaining the end of the tie rod assembly on the block member while permitting movement of the tie rod assembly in the third hole.

9. A process as set forth in claim 8 which includes, securing the block member in position on the rod member end portions by exerting a force on the tie rod assembly to urge the block member into abutting relation with the obstruction on the rod member end portions, and maintaining tension on the tie rod assembly to maintain the block member abutting the obstruction and immovable on the rod member end portions.

* * * * *